United States Patent [19]

Kadija

[11] 4,432,838

[45] Feb. 21, 1984

[54] METHOD FOR PRODUCING RETICULATE ELECTRODES FOR ELECTROLYTIC CELLS

[75] Inventor: Igor V. Kadija, Cleveland, Tenn.

[73] Assignee: Olin Corporation, New Haven, Conn.

[21] Appl. No.: 394,756

[22] Filed: Jul. 2, 1982

Related U.S. Application Data

[60] Division of Ser. No. 146,558, May 5, 1980, Pat. No. 4,350,580, which is a continuation-in-part of Ser. No. 143,970, Apr. 25, 1980, Pat. No. 4,370,214.

[51] Int. Cl.[3] ..... C25D 1/08; C25D 5/02; C25B 9/00; C25B 11/03

[52] U.S. Cl. ..... 204/11; 204/16; 204/35 R; 204/252; 204/253; 204/284; 204/290 F; 204/290 R; 204/292; 204/293

[58] Field of Search ..... 204/284, 292–293, 204/290 R, 290 F, 279, 11, 16, 35 R, 252; 427/123, 125; 429/42

[56] References Cited

U.S. PATENT DOCUMENTS

| | | | |
|---|---|---|---|
| 3,759,799 | 9/1973 | Reinke | 204/11 X |
| 3,959,113 | 5/1976 | Kelly | 204/284 X |
| 4,236,993 | 12/1980 | Muller et al. | 204/294 |
| 4,248,682 | 2/1981 | Lindstrom et al. | 429/42 X |
| 4,293,396 | 10/1981 | Allen et al. | 429/42 X |

FOREIGN PATENT DOCUMENTS 1465642 1/1967 France .

OTHER PUBLICATIONS

A. Tentorio and U. Casolo-Ginelli, Characterization of Reticulate, Three-Dimensional Electrodes, 1978, pp. 195–205.

Y. Volkman, Optimization of the Effectiveness of a Three-Dimensional Electrode with Respect to its Ohmic Variables, 1979, pp. 1145, 1149.

*Primary Examiner*—Donald R. Valentine

*Attorney, Agent, or Firm*—James B. Haglind; Donald F. Clements

[57] ABSTRACT

A current distributor for an electrode for an electrolytic cell for the electrolysis of aqueous solutions of ionic compounds is provided which comprises an electrically conductive material having a front surface comprised of a plurality of electrode-engaging means projecting from it for attachment to a foraminous electrode. The rear surface of the current collector is suitable for attachment to an electrical conductor. The novel current distributors are particularly suitable for use with reticulate electrodes.

12 Claims, 6 Drawing Figures

METHOD FOR PRODUCING RETICULATE ELECTRODES FOR ELECTROLYTIC CELLS

This is a division of application Ser. No. 146,558 filed May 5, 1980, now U.S. Pat. No. 4,350,580, issued Sept. 21, 1982, which is a continuation-in-part of application Ser. No. 143,970, filed Apr. 25, 1980, now U.S. Pat. No. 4,370,214, issued Jan. 25, 1983.

This invention relates to electrodes for use in electrolytic cells. More particularly, this invention relates to current distributors for electrodes for electrolytic cells.

In electrolytic cells employed in the electrolysis of aqueous solutions of ionizable compounds such as alkali metal chlorides, foraminous metal electrodes are used which are constructed of perforated plates, meshes or screens, and expanded metals. These electrodes employ significant amounts of metal and have a high ratio of metal weight to surface area and significant polarization values. As the cost of electric power has increased, various ways have been sought to increase the surface area of these electrodes and to reduce their polarization values and thus lower the power consumption for their operation.

A recent attempt to increase the surface area of electrodes has been the development of the three dimensional electrodes such as reticulate electrodes. A. Tentorio and U. Casolo-Ginelli have described one type of reticulate electrode (J. Applied Electro-Chemistry 8, 195–205, 1978) in which an expanded, reticulated polyurethane foam was metallized by means of the electroless plating of copper. A thin layer of copper (about 0.34 m) was formed which conferred electrical conductivity to the matrix. Galvanic plating was employed to deposit additional amounts of copper. The reticulate electrode was employed in a cell for the electrolysis of a copper sulfate solution.

An improved form of reticulate electrode is one fabricated by affixing filaments to a support fabric to form a network of filaments. An electroconductive metal is then deposited on the filaments to coat the filaments and to provide interfilament bonding at contact sites between adjacent filaments. The support fabric is then removed to provide a highly porous, highly conductive reticulate electrode which is mechanically strong while employing greatly reduced amounts of the electroconductive metal.

In producing these porous three dimensional electrodes having high surface areas, an electroconductive metal is deposited on the structure by electroplating. As these reticulate electrodes are formed of a network of fine filaments having thicknesses in terms of microns, electric current distributors used with these electrodes must make contact with all of the elements as feeding current to a few of the filaments will result in their being overheated and they will melt.

Current distributors are then needed which have multiple contacts to engage the filaments of reticulate electrodes and uniformly and efficiently distribute current to them. In addition, current distributors are required which can be readily attached to reticulate type electrodes.

It is an object of the present invention to provide current distributors for reticulate electrodes.

Another object of the present invention is to provide current distributors which can be readily attached to reticulate electrodes.

An additional object of the present invention is to provide current distributors which will provide uniform current distribution to reticulate electrodes.

A further object of the present invention is to provide a current distributor which can be readily combined with current conductors to form a re-usable current transfer system for reticulate electrodes.

These and other objects of the invention are accomplished in a method for distributing electric current to a foraminous electrode used in an electrolytic cell for the electrolysis of aqueous solutions of ionic compounds, the improvement which comprises employing as a current distributor:

an electrically conductive material having a front side comprised of a plurality of electrode-engaging means projecting from the surface for attachment to the foraminous electrode, and a substantially planar back side suitable for attachment to an electrical conductor.

Other advantages of the invention will become apparent upon reading the description below and the invention will be better understood by reference to the attached FIGURES.

Figure 1:
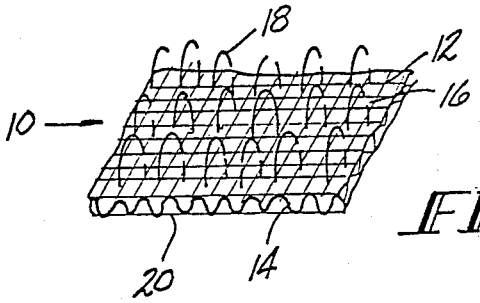
FIG. 1 shows a perspective view of one embodiment of the current distributor of the present invention.

FIG. 1 shows current distributor 10 comprised of a flexible metallic strip 12 comprised of metallic fibers 14 having front side 16 and back side 20. Metal hooks 18 project outward from front side 16.

Figure 2:
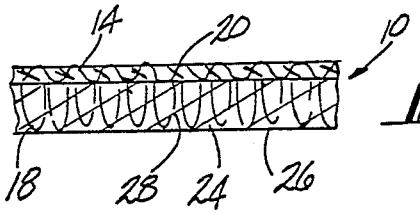
FIG. 2 is a partial cross-sectional view of the current distributor of FIG. 1 and an attached electrode taken in a direction perpendicular to the front side of the current distributor.

FIG. 2 illustrates current distributor 10 attached to reticulate electrode 26 by means of metal hooks 18 engaging electrode filaments 28 affixed in support fabric 24.

Figure 3:
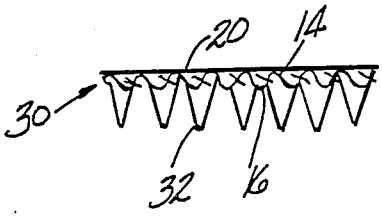
FIG. 3 is a partial cross-sectional view through an alternative embodiment of the current distributor having point electrode-engaging means taken in a direction perpendicular to the front side of the distributor.

FIG. 3 depicts an end view of current conductor 30 having pointed electrode-engaging components 32 projecting from front side 16.

Figure 4:
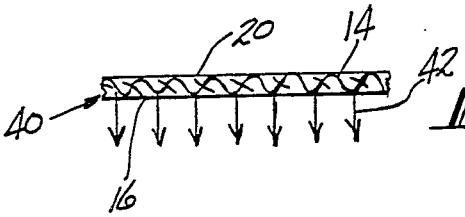
FIG. 4 is a partial cross-sectional view through another alternative embodiment of the current distributor having barbed electrode-engaging means taken in a direction perpendicular to the front side of the distributor.

The end view of current conductor 40 having barbed electrode-engaging components 42 projecting from front side 16 is shown in FIG. 4.

Figure 5:
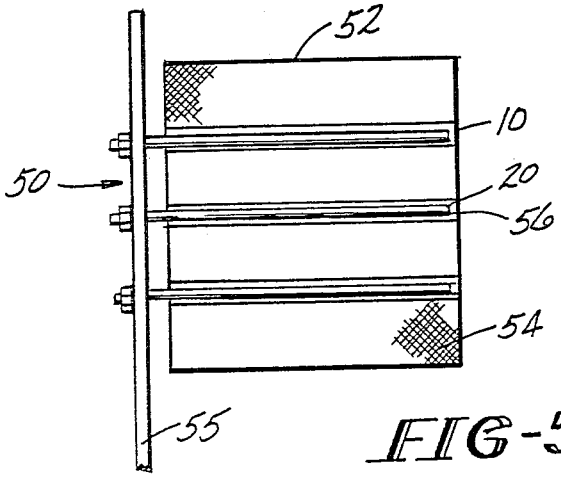
FIG. 5 represents an electrode assembly employing the current distributor of the present invention in which conductor rods are attached to the back side of the current distributors.

FIG. 5 shows electrode assembly 50 in which mesh electrode 52 has three current distributors 10 attached to electrode surface 54. Welded to back side 20 of current distributors 10 are conductor rods 56. Conductor rods 56 are bolted to bus bar 55 which supplies electric current to electrode 52.

Figure 6:
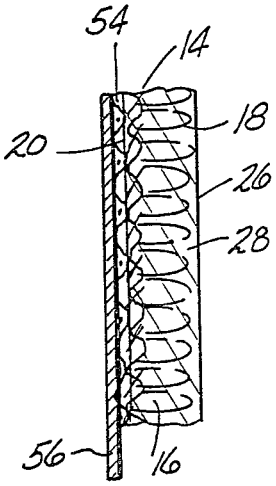
FIG. 6 shows a partial cross-sectional view of the electrode of FIG. 2 having a support frame attached to the back side of the current distributor.

FIG. 6 illustrates an electrode assembly in which conductor rod 56 is welded to support frame 54. Also welded to support frame 54 is back side 20 of current distributor 10. Reticulate electrode 26 is attached to current distributor 10 by means of metal hooks 18 engaging electrode filaments 28.

More in detail, the novel current distributors of the present invention are fabricated from electrically conductive materials. In the embodiment shown in FIG. 1, an electrically conductive fabric is formed, for example, by weaving together metallic threads in a manner which provides loops on one side of the fabric. The metallic threads which form the fabric are a few microns thick while those which form the loops are considerably thicker, for example, in the range of about 20 to about 150, and preferably from about 50 to about 120 microns. The loops are then cut near their outer ends to provide hooks which serve as the electrode-engaging means. Similarly, a current distributor can be produced by the incorporation of molded hooks or barbs into a flexible metallic substrate. The electrode-engaging means project unidirectionally from the front side of the fabric and are preferably perpendicular to the front side. The back side of the electrically conductive fabric is substantially planar and preferably flat for attachment to current conductors, but may be ridged, if desired. Electrically conductive fabrics composed of fibers of metals such as steel, nickel, silver, or their alloys, or natural or synthetic fibers such as nylon coated with these metals are suitable as current distributors. Fabrics of this type are available commercially under the trademark VELCRO from Velcro USA, Inc.

The novel current distributor of the present invention is attached to an electrode surface by attaching the electrode-engaging means to elements of the electrode. The current distributor should have a sufficient number of electrode-engaging means to provide a connection, for example, suitable for distributing current to or collecting current from the electrode surface. Current distributors having at least two electrode-engaging means per square centimeter of current conductor are suitable. Preferred, however, are current distributors having from about 4 to about 200, and more preferred are those having from about 25 to about 150 electrode-engaging means per square centimeter.

As previously mentioned, the novel current distributors are attached to electrode surfaces by means of the electrode-engaging means. Any foraminous electrode surface may be suitably connected including those fabricated of screen, mesh, expanded metal and the like which have a sufficient number of elements to which the electrode-engaging means can attach themselves. The current distributors of the present invention are particularly suitable for use with three dimensional electrode structures such as reticulate electrodes. Reticulate electrodes are formed of a network of fine filaments to which the electrode-engaging means are readily attached. One example is the electrode structure of A. Tentorio and U. Casolo-Ginelli composed of a reticulated polyurethane structure coated with a metal such as copper. Another example is a reticulate electrode formed by affixing filaments to a support fabric to form a network of filaments. An electroconductive metal is deposited on the filaments to form metal coated filaments and to provide interfilament bonding at contact sites between adjacent filaments to produce a mechanically strong structure. The support fabric is then removed and a porous reticulate electrode is produced having high internal surface area and high conductivity while greatly reducing the amount of metal required. In fabricating electrodes of this type, the filaments employed include fibers, threads, or fibrils. The filaments may be those of the electroconductive metals themselves, for example, nickel, titanium, or steel; or of materials which can be coated with an electroconductive metal.

Any materials which can be electroplated with these electroconductive metals may be used in filament formation. Suitable materials include, for example, metals such as silver or copper, plastics such as polyarylene sulfides, polyolefins produced from olefins having 2 to about 6 carbon atoms and their chloro- and fluoro-derivatives, nylon, melamine, acrylonitrile-butadiene-styrene (ABS), and mixtures thereof.

Where the filaments to be coated are non-conductive to electricity, it may be necessary to sensitize the filaments by applying a metal such as silver, nickel, aluminum, palladium or their alloys by known procedures. The electroconductive metals are then deposited on the sensitized filaments.

The filaments are affixed to a support fabric prior to the deposition of the electroconductive metal. Any fabric may be used as the support fabric which can be removed from the reticulate electrode structure either mechanically or chemically. Support fabrics include those which are woven or non-woven and can be made to natural fibers such as cotton or rayon or synthetic fibers including polyesters, nylons, polyolefins such as polyethylene, polypropylene, polybutylene, polytetrafluoroethylene, or fluorinated ethylenepropylene (FEP) and polyarylene compounds such as polyphenylene sulfide. Preferred as support fabrics are those of synthetic fibers such as polyesters or nylon. Fabric weights of 100 grams per square meter or higher are quite suitable for the support fabrics.

Filaments are affixed to the support fabric in arrangements which provide a web or network having the desired porosity. The filaments are preferably randomly distributed while having a plurality of contact points with adjacent filaments. This can be accomplished by affixing individual filaments to the support fabric in the desired arrangement or by providing a substrate which includes the filaments. Suitable substrates are lightweight fabrics having a fabric weight in the range of from about 4 to about 75 grams per square meter. A preferred embodiment of the substrate is a web fabric of, for example, a polyester or nylon.

Filaments or the substrate may be affixed to the support fabric, for example, by sewing or needling. Where the filaments are affixed to a thermoplastic material, energy sources such as heat or ultrasonic waves may be employed. It may also be possible to affix the filaments by the use of an adhesive.

An electroconductive metal is then deposited on the filaments, for example, by electroplating. Any electroconductive metal may be used which is stable to the cell environment in which the electrode will be used and which does not interact with other cell components.

Examples of suitable electroconductive metals include nickel, nickel alloys, molybdenum, molybdenum alloys, vanadium, vanadium alloys, iron, iron alloys, cobalt, cobalt alloys, mangesium, magnesium alloys, tungsten, tungsten alloys, gold, gold alloys, platinum group metals, and platinum group metal alloys. The term "platinum group metal" as used in the specification means an element of the group consisting of platinum, ruthenium, rhodium, palladium, osmium, and iridium.

Preferred electroconductive metals are nickel and nickel alloys, molybdenum and molybdenum alloys, cobalt and cobalt alloys, and platinum group metals and their alloys. It is further preferred that where the electrode will contact an ionic compound such as an alkali metal hydroxide, the electroconductive metal coating be that of nickel or nickel alloys, molybdenum and molybdenum alloys, cobalt and cobalt alloys. Where the electrode will contact an ionic compound such as an alkali metal chloride, the electroconductive metal coating be that of a platinum group metal or an alloy of a platinum group metal.

During the deposition of the electroconductive metal, interfilament bonding occurs where the filaments contact each other as the deposited metal "grows" over and encloses the contact site. As there are many contact sites between filaments in the structure, interfilament bonding occurs frequently and the electrode structure produced is mechanically strong.

Sufficient amounts of the electroconductive metal are deposited on the filaments to produce an electrode structure having adequate mechanical strength and which is sufficiently ductile to withstand the stresses and strains exerted upon it during its use in electrolytic processes without cracking or breaking. Suitable amounts of electroconductive metals include those which increase the diameter of the filaments up to about 5 times and preferably from about 2 to about 4 times the original diameter of the filaments. While greater amounts of electroconductive metal may be deposited on the filaments, the coated filaments tend to become brittle and to powderize under these conditions. Prior to the deposition of the electroconductive metal, the filaments have diameters in the range of from about 1 to about 100, preferably from about 2 to about 50, and more preferably from about 5 to about 15 microns. Following the deposition of the electroconductive metal, the filaments have diameters in the range of from about 2 to about 200, preferably from about 6 to about 150, and more preferably from about 15 to about 75 microns.

After deposition of the electroconductive metal has been accomplished, the support fabric is removed. With cloth-like fabrics, these can be readily peeled off or cut off the metal structure. Non-woven or felt support fabrics can be, for example, loosened or dissolved in solvents including bases such as alkali metal hydroxide solutions or acids such as hydrochloric acid. Any solvent may be used to remove the support fabrics and substrates which will not corrode or detrimentally effect the electrode structure. Heating may also be employed, if desired, to remove the support fabrics. Where a substrate containing the filaments is used, the temperature to which the metal coated electrode is heated should be less than the melting point or decomposition temperature of the substrate.

The resulting reticulate electrode thus produced is highly porous, having a porosity above about 80 percent, preferably above about 90 percent, and more preferably in the range of from about 95 to about 98 percent. The porosity is defined as the ratio of the void to the total volume of the reticulate electrode.

The novel current distributors of the present invention are attached to the reticulate electrodes prior to the deposition of the electroconductive metal. The electrode-engaging means penetrate the electrode structure and attach themselves to a plurality of filaments. For example, using a current conductor of the type of FIGS. 1 and 2, each hook has several electrode filaments attached. Thus, the current conductor is connected to substantially all of the filaments and permits controlled current flow to the electrode and results in substantially uniform deposition of the electroconductive metal. To provide for efficient current distribution over the entire electrode surface, several current collectors may be attached to the electrode surface and spaced apart by a suitable distance, for example, from about 2 to about 20, and preferably from about 5 to about 15 centimeters. A section of the current conductor may extend beyond the electrode area to be used as a lead to which the current source is attached, if desired.

The electrode with the current distributor attached, is then electroplated to deposit a coating of the electroconductive metal on the filaments. Electroplating is conducted using known procedures and plating baths. Where small filaments are used in the electrode surface, it may be desirable to employ reduced current loads during the first few minutes of the plating period before increasing the current to the normal level.

During the electroplating process, the filaments are coated with the electroconductive metal and interfilament bonding takes place where filaments are in contact with each other. Electroconductive metal is also deposited on the current distributors. Following the electroplating operation, the current distributors may be peeled off the electrode structure and re-used in the preparation of another electrode.

In a preferred embodiment, the current distributors remain attached to the electrode surface and become a permanent part of the electrode structure. The back side of the current distributors can be attached, for example, by brazing or welding to electrode posts or bus bars which supply current to or remove current from the electrode.

In an alternate embodiment, a conductive support frame may be attached to the back side of the current distributors to provide additional mechanical support for reticulate electrodes of the size employed in commercial electrolytic cells. The support frame, for example, a mesh or screen, should have an open area of about 80 percent or greater by volume. Conductor rods may be attached to the support frame as shown in FIG. 6.

Electrodes incorporating the novel current distributors of the present invention may be used in electrolytic cells which are employed commercially in the production of chlorine and alkali metal hydroxides by the electrolysis of alkali metal chloride brines. These include monopolar cells, bipolar cells, and filter press cells of either type. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl.

Where the electroconductive metal deposited is platinum, the electrodes may be suitably employed as the anodes. Nickel coated electrodes having the current collectors of the present invention may serve as the cathodes. These cells may employ electrolyte permeable diaphragms, solid polymer diaphragms, or ion exchange membranes to separate the anodes from the cathodes and include monopolar and bipolar type cells including the filter press type. Anodes having the current distributors of the present invention may also be employed in cells having a mercury cathode.

The novel current distributors of the present invention are illustrated by the following examples without any intention of being limited thereby.

EXAMPLE 1

A web of silver coated nylon fibers (20 grams per square meter; fiber diameter about 10 microns) was needled onto a section of a polyester cloth (250 grams per square meter; air permeability 50 cubic meters per minute per square meter). A strip (0.6 cm wide) of a conductive fabric composed of silver coated nylon fibers having hooks projecting from one side was attached to the web as a current distributor (Velcro USA, Inc. HI-MEG metallized VELCRO). The conductive fabric contained multiple rows of hooks (about 75 per square centimeter) which firmly connected the current distributor to the web fabric. The current distributor-web-polyester cloth composite was immersed in an electroplating bath containing 450 grams per liter of nickel sulfamate and 30 grams per liter of boric acid at a pH in the range of 3–5. Initially electric current was passed through the solution at a current density of about 0.2 $KA/m^2$ of electrode surface. After about 10 minutes, the current was increased to provide a current density of 0.5 $KA/m^2$. During the electroplating period of about 3 hours, an electroconductive nickel coating was deposited on the silver fibers. Where adjacent fibers touched, plated joints formed to bond the fibers together into a network. After removal from the plating bath, the nickel plated structure was rinsed in water. The current collector and polyester fabric were peeled off and an integrated nickel plated structure obtained having a weight of 580–620 grams per square meter in which the nickel coated fibers were on the average, about 30 microns thick. To determine its polarization characteristics, the nickel plated structure was employed as an electrode in a half cell containing a standard calomel electrode and an aqueous solution of sodium hydroxide (35% by weight of NaOH) at 90° C. As an electrode, the nickel plated structure was mechanically strong and did not require reinforcing or supporting elements. An electric current of 2.0 $KA/m^2$. was passed through the cell and the polarization value determined was $-1.470$ volts $\pm 10$ millivolts.

EXAMPLE 2

A silver coated nylon web of the type employed in Example 1 was needled into a section of a polyester felt fabric (190 grams per square meter). A strip (0.6 cm wide) of a conductive fabric (Velcro USA, Inc. HI-GARD all metal VELCRO) containing steel fibers having about 75 hooks per square centimeter attached to one side of the fabric was attached to the web as current distributors. The silver sensitized felt fabric was then plated with nickel using the electroplating procedure of Example 1. The plating procedure produced an integrated structure of nickel coated fibers bonded by a plurality of plated joints connecting portions of adjacent fibers. The current distributor was also coated with nickel and became an integral part of the electrode. The plated structure had a weight of 780 to 840 grams per square meter. After rinsing with water, the nickel structure was immersed in an aqueous solution of sodium hydroxide (25% NaOH) which dissolved away the polyester felt.

EXAMPLE 3

A cathode for an electrolytic cell for the electrolysis of sodium chloride was fabricated from an expanded nickel mesh having an open area of about 80 percent. Nickel conductor rods were spot welded to the back side of the mesh. Current distributors of the type of FIG. 1 (HI-GARD all metal VELCRO) in strips 0.6 centimeters wide were welded along the back side to the nickel screen. The current collectors were spaced apart 2.7 centimeters and positioned diagonally across the screen. A nickel coated reticulate electrode of the type produced by the plating process of Example 1 was affixed to the structure by attaching the hooks on the current collectors to the filaments of the reticulate electrode to provide an electrode assembly of the type of FIG. 6. Polarization characteristics of the electrode were determined in the half cell of Example 1 using a standard calomel reference electrode 35% NaOH at 85° C. as the electrolyte. Polarization values of $-1.43$ volts at a current density of 2 $KA/M^2$ and $-1.50$ volts at a current density of 4 $KA/M^2$ were obtained.

What is claimed is:

1. A reticulate electrode for use in the electrolysis of ionic compounds which comprises a network of electroconductive metal filaments, said network having interfilament bonding at contact sites between adjacent filaments, and having attached to said network a current distributor comprised of an electrically conductive fabric having a front side comprised of a plurality of electrode-engaging means projecting from said front side for attachment to said network of electroconductive metal filaments and a substantially planar back side suitable for attachment to an electrical conductor.

2. The reticulate electrode of claim 1 in which a conductive support framework is attached to said rear surface of said current distributor.

3. The reticulate electrode of claim 2 having a porosity of at least 80 percent.

4. The reticulate electrode of claim 3 in which said electroconductive metal is selected from the group consisting of nickel, nickel alloys, molybdenum, molybdenum alloys, cobalt, cobalt alloys, vanadium, vanadium alloys, tungsten, tungsten alloys, titanium, titanium alloys, gold, gold alloys, platinum group metals and platinum group metal alloys.

5. The reticulate electrode of claim 4 in which said filaments are comprised of a metal selected from the group consisting of nickel, nickel alloys, titanium, titanium alloys, steel, silver or copper.

6. The reticulate electrode of claim 5 in which said filaments are comprised of a plastic selected from the group consisting of polyarylene sulfides, polyolefins produced from olefins having 2 to about 6 carbon atoms and their chloro- and fluoro- derivatives, and nylon, said plastics being sensitized by a metal selected from the group consisting of silver, aluminum or palladium.

7. The reticulate electrode of claim 5 or 6 in which said reticulate electrode has a porosity of from about 95 to about 98 percent.

8. A method for producing a reticulate electrode for use in the electrolysis of aqueous solutions of ionic compounds which comprises:

(a) affixing filaments to a support fabric to form a network of filaments, (b) attaching to said network of filaments a current distributor comprised of an electrically conductive fabric having a front side comprised of a plurality of electrode-engaging means projecting from said front side for attachment to said network of filaments and a substantially planar back side suitable for attachment to an electrical conductor, (c) depositing by electroplating an electroconductive metal on said network of filaments and said current distributor, said deposition forming metal coated filaments and providing interfilament bonding at contact sites between adjacent filaments, and (d) removing said support fabric from said metal coated filament network to produce a reticulate electrode having a porosity of at least about 80 percent.

9. The method of claim 8 in which said filaments are in the form of a web affixed to said support fabric.

10. In an electrolytic cell for the electrolysis of aqueous solutions of ionic compounds, said cell having an anode assembly containing a plurality of anodes, a cathode assembly having a plurality of cathodes, a diaphragm or membrane operating said anode assembly from said cathode assembly, and a cell body housing said anode assembly and said cathode assembly, the improvement which comprises employing as said cathodes reticulate electrodes produced by the method of claim 8 having nickel as the electroconductive metal.

11. The method of claim 9 in which said support fabric is removed from said metal coated filament network by mechanical means.

12. The method of claim 9 in which said support fabric is removed from said metal coated filament network by dissolving said support fabric in a solvent.

* * * * *

UNITED STATES PATENT AND TRADEMARK OFFICE

CERTIFICATE OF CORRECTION

PATENT NO. : 4,432,838

DATED : February 21, 1984

INVENTOR(S) : Igor V. Kadija

It is certified that error appears in the above-identified patent and that said Letters Patent is hereby corrected as shown below:

At Column 4, line 26, delete "to" and insert --of--.

At Column 10, Claim 10, line 5, delete "operating" and insert --separating--.

Signed and Sealed this

*Fifteenth* Day of *May 1984*

[SEAL]

*Attest:*

GERALD J. MOSSINGHOFF

*Attesting Officer*

*Commissioner of Patents and Trademarks*